US005317325A

United States Patent [19]

Bottomley

[11] Patent Number: 5,317,325

[45] Date of Patent: May 31, 1994

[54] RADIO ANTENNAS

[75] Inventor: Howard Bottomley, Aylesbury, England

[73] Assignee: Antenna Products Limited, Great Britain

[21] Appl. No.: 850,050

[22] Filed: Mar. 12, 1992

[30] Foreign Application Priority Data

Mar. 16, 1991 [GB] United Kingdom ..... 9105586

[51] Int. Cl.[5] ..... H01Q 1/24

[52] U.S. Cl. ..... 343/702; 343/895; 343/901

[58] Field of Search ..... 343/702, 715, 895, 900, 343/901, 903; H01Q 1/24, 1/32

[56] References Cited

U.S. PATENT DOCUMENTS 4,121,218 10/1978 Irwin et al. ..... 343/895
4,725,845 2/1988 Phillips ..... 343/895
4,868,576 9/1989 Johnson, Jr. ..... 343/895
4,916,456 4/1990 Shyu ..... 343/715

*Primary Examiner*—Donald Hajec
*Assistant Examiner*—Hoanganh Le
*Attorney, Agent, or Firm*—Lee, Mann, Smith, McWilliams, Sweeney & Ohlson

[57] ABSTRACT

A radio antenna has an antenna element 12 which is slidable with respect to a casing of the radio between an extended position (FIG. 5) and a retracted position. In the extended position, a metal plate 15 on the lower end of the antenna element 12 cooperates with a fixed dielectric 17 and a fixed metal plate 17 to form a capacitor providing a signal link to a coaxial cable 18 leading to a matching network. This avoids the need for a sliding metal connection, as in the prior art. In the retracted position of the antenna element 12, the capacitive link is effectively disconnected.

7 Claims, 3 Drawing Sheets

RADIO ANTENNAS

FIELD OF THE INVENTION

This invention relates to radio antennas, particularly for portable radios which have antennas slidable and/or pivotable with respect to the radio set.

BACKGROUND TO THE INVENTION

There exists a requirement for antennas on portable radio equipment to have the facility of being operational when retracted into the set and of offering improved performance when extended, or to be capable of being laid down alongside the equipment for transport or convenience, or to achieve a suitable angle for operation.

Conventionally this is achieved by a mechanical telescopic rod or a fixed rod which slides out, or by a pivot arrangement, created by a "tongue and slot" in metal with a method of maintaining friction.

Both these methods require a mechanical connection to the rod in order to provide the electrical "joint" to the radio.

This mechanical interface is prone to problems from two areas:

1) The connection point is subject to wear resulting in intermittent contact.
2) It is very difficult to maintain a consistent and repeatable joint to allow optimisation of the various tuning components within the radio.

DISCLOSURE OF THE INVENTION

According to the invention a radio antenna comprises an antenna element movable with respect to a metal member spaced from the antenna element, the antenna element and metal member forming a capacitor which constitutes an electrical signal link between the antenna element and the metal member which in use is connected to the radio transmitting or receiving apparatus. Hence, the provision of the capacitative link avoids the need for a mechanical connection between the antenna element and the radio transmitting or receiving apparatus.

The antenna element may be slidable with respect to the metal member, and in this case the element may be a rod slidably movable, between extended and retracted positions, past the metal member. The rod may itself form one "plate" of the capacitor or may carry a metal plate which cooperates with the metal member when the antenna is in a particular operative position, e.g. in its fully extended position. The antenna element may carry a further metal plate positioned so that it cooperates with the metal member when the antenna element is in its retracted position.

Alternatively, the antenna element may be pivotally movable with respect to the metal member, and in this case the antenna element has, at or adjacent the pivot region, a metal body which cooperates with the metal member. Preferably the pivot of the antenna element has a circular or annular metal body which faces and cooperates with the metal member which is then also preferably circular or annular.

The antenna element may be both pivotally and slidably movable but in each case the element, with the optional addition of metal bodies as appropriate, cooperates with the metal member.

In all cases the metal member is preferably connected to a matching network so that the combination of the capacitor and the matching network provides the impedance which the radio equipment is required to see.

The invention has particular application to hand portable radios, and the invention includes within its scope a portable radio handset having an antenna according to the invention.

BRIEF DESCRIPTION OF THE DRAWINGS

Radio antennas according to the invention will now be described by way of example with reference to the accompanying drawings, in which.

DESCRIPTION OF THE PREFERRED EMBODIMENTS

Figure 1:
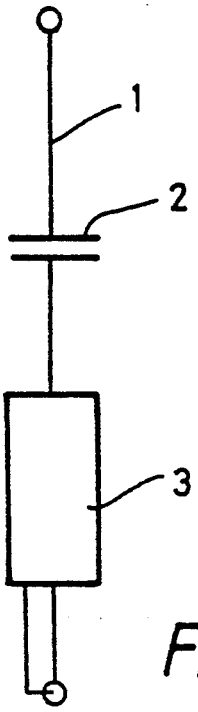
FIG. 1 is a diagrammatic view of an antenna according to the invention.

Referring to FIG. 1, the antenna comprises an antenna element 1 connected by a series capacitor 2 through a matching network 3 to the radio receiving apparatus (not shown) of a portable radio handset. The matching network 3 is designed to transform the impedance of the radio receiving apparatus to that of the antenna element. FIG. 1 is the electrical diagram of each of the embodiments of FIGS. 2 to 7.

Figure 2:
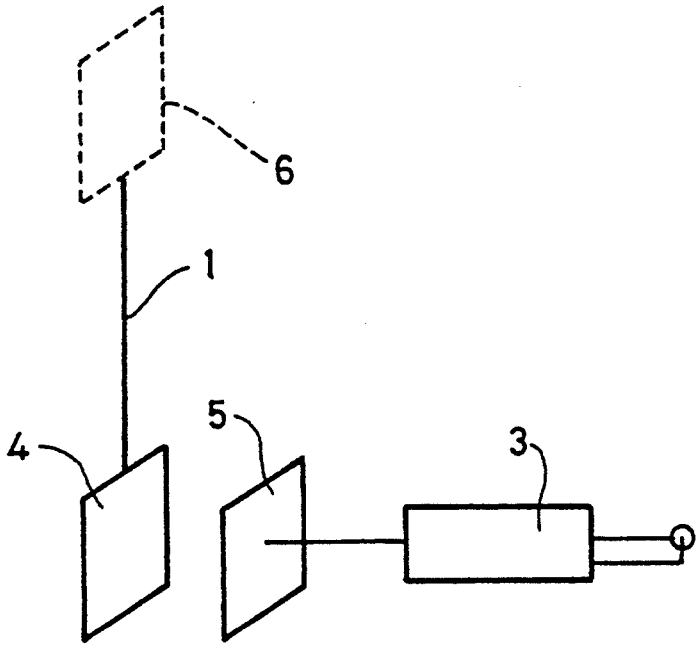
FIG. 2 is a schematic view of a first embodiment of antenna according to the invention.

In FIG. 2, the element 1 (in the form of a metal rod) carries at its lower end a metal plate 4 which serves as one plate of the capacitor 2, the other plate 5 of which is fixed in the radio and is connected by the matching network 3 to the radio receiving apparatus. The antenna element 1 is slidably mounted in a housing of the radio and the movable plate 4 is positioned so that it cooperates with the fixed plate 5 when the antenna element is in its fully extended position. The extremity of the element 1 may carry a further metal plate 6 positioned so as to cooperate in a capacitive sense with the plate 5 when the element 1 is in its retracted position.

Figure 3:
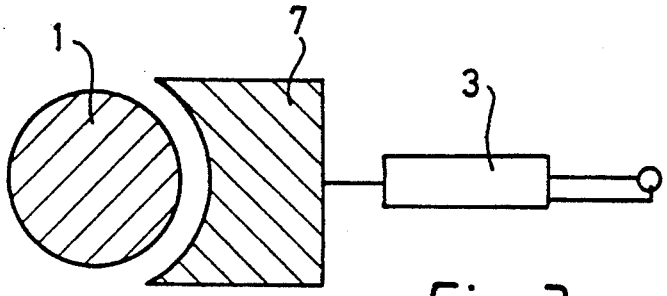
FIG. 3 is a diagrammatic plan view of a second embodiment of antenna according to the invention.

In FIG. 3, an antenna element 1 in the form of a cylindrical rod is slidably movable (with an intervening air gap) past a fixed metal plate 7 which has an arcuate edge facing the rod, such that the rod 1 and plate 7 form the capacitor 2. The plate 7 is connected to a matching network 3 and thence to the radio receiving apparatus, in a manner comparable with FIGS. 1 and 2.

Figure 4:
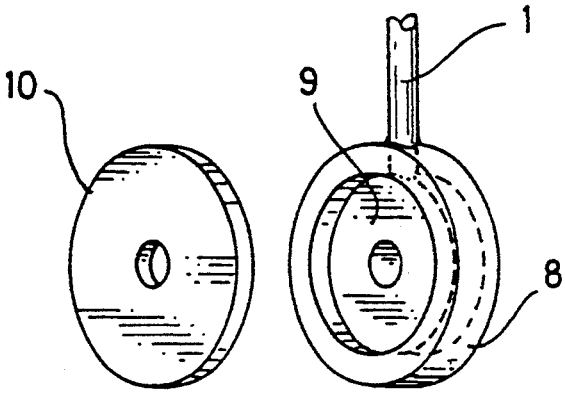
FIG. 4 is a fragmentary perspective view showing a third embodiment of antenna.

In FIG. 4 the antenna element 1 is in the form of a rod which is pivotally mounted in the housing of the radio. The base of the rod has a boss-like pivot 8 moulded to incorporate an annular metal plate 9. This metal plate 9 is recessed in the boss-line pivot 8 and cooperates with a fixed annular metal plate 10 mounted in the radio housing and connected by a matching network to the radio receiving apparatus. The plates 9 and 10 provide the capacitor 2, in all pivotal positions of the antenna element 1.

In a further embodiment (not illustrated) the antenna comprises two concentric metal rods or tubes forming the capacitor plates, one of which is fixed and connected to a matching circuit and the other of which is slidably movable.

Figure 5:
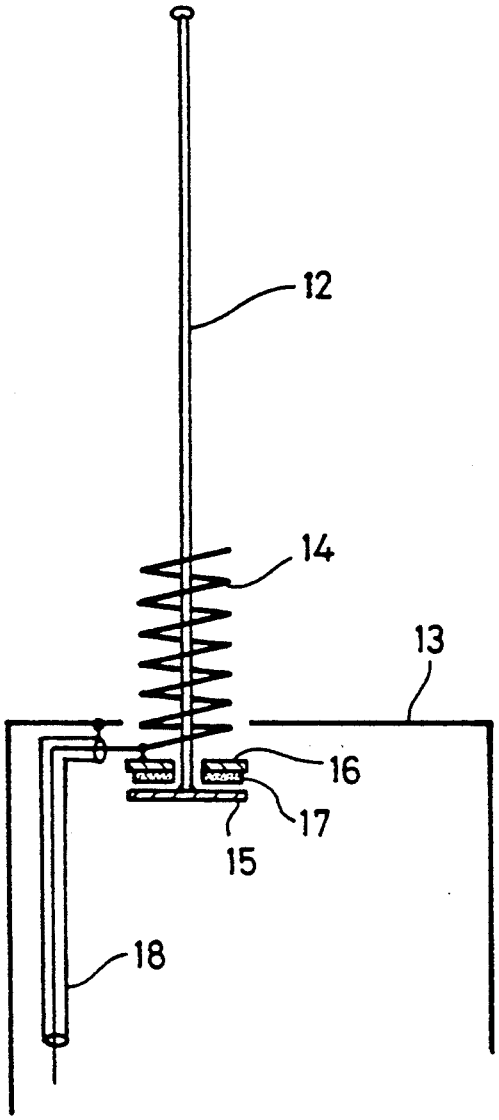
FIG. 5 shows a forth embodiment of antenna.
Figure 6:
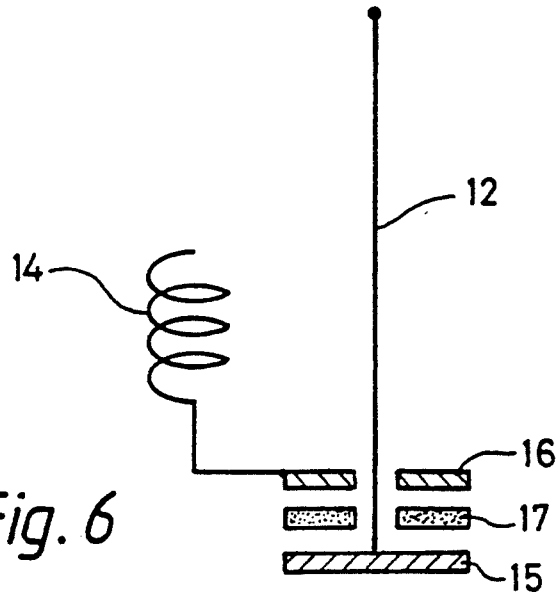
FIG. 6 is an equivalent circuit for the antenna of FIG. 5.

In the embodiment shown in FIGS. 5 and 6 a whip antenna has an antenna element 12 slidably mounted with respect to a metal chasis 13 providing a ground plane. This enables the antenna element to be slidable between a fully extended position (shown in FIG. 5) and a fully retracted position in which the upper end of the whip antenna 12 is positioned very slightly above the upper turn of a helical antenna 14.

The whip antenna element has a length of 7.62 cm and, when extended, is therefore resonant as a quarter wavelength antenna at 866 MHz. The lower end of the whip antenna element 12 is attached to a capacitor plate 15 which (when the antenna element is extended) cooperates with a fixed capacitor plate 16. A dielectric washer 17 is positioned between the fixed and movable plates, so that the complete assembly provides a capacitor link for the antenna to a 50 ohm feed cable 18 which is connected to a matching network.

The lower end of the antenna element is surrounded by the helical antenna 14 which, when the element 12 is retracted, is resonant at 866 MHz. The antenna element 14 is connected to the fixed capacitor plate 16 which is itself connected to the core of the 50 ohm co-axial feed cable 18.

FIG. 6 shows, in diagrammatic form, the equivalent electrical circuit of the whip antenna of FIG. 5.

Figure 7:
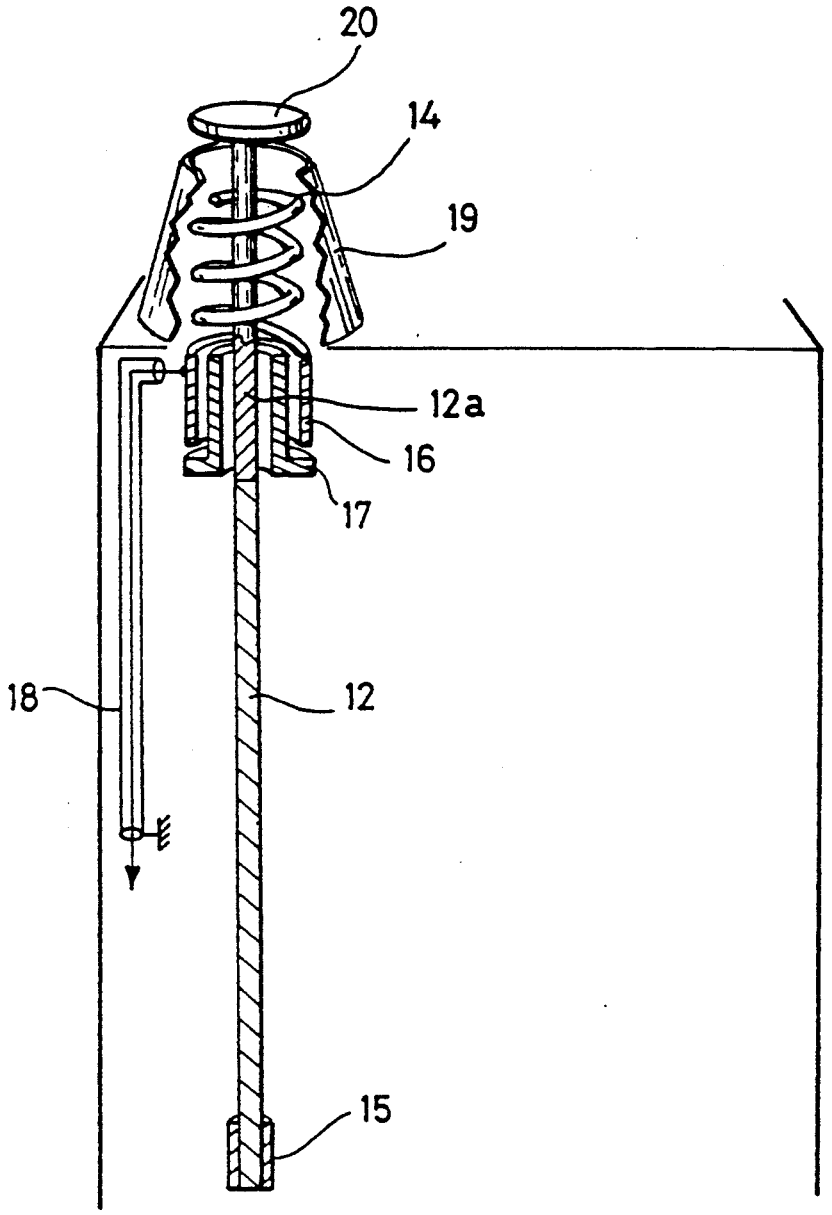
FIG. 7 shows a fifth embodiment of antenna.

FIG. 7 shows a modification of the antenna system of FIGS. 5 and 6. In FIG. 7 the helical antenna 14 is surrounded and protected by a tapering plastics sleeve 19, the upper end of which is closed by a cap 20 on the upper end of the antenna element 12 when the latter is in its retracted position. The antenna element 12 is largely of metal, but its upper section 12*a* is of a non-metallic material, e.g. plastics, so that no metal is within the field of the helical antenna element 14 when the antenna element is retracted. The fixed and grounded capacitor plate 16 is in the form of a tube and the dielectric 17 takes the form of a flanged sleeve positioned within the tubular capacitor plate 16. The cooperating and movable capacitor plate 15 is formed by a thickened section of metal on the lower end of the element 12.

It will be appreciated that when the antenna element 12 is extended, the thickened section 15 is disposed within the dielectric 17 and fixed capacitor plate 16. In order to maintain the whip element 12 in the extended position, cooperating latching formations may be provided on the components 15 and 17.

When the antenna element 12 of FIG. 7 is extended, the length of metal antenna element is such that the antenna functions as a quarter wavelength antenna and is resonant at 866 MHz. In the extended position of the antenna element 12 the capacitor provided by the components 15, 16 and 17 provides the link to the co-axial feed cable 18. When the antenna element 12 of FIG. 7 is retracted, the helical antenna element 14 is resonant at 866 MHz, and the capacitor is effectively disconnected.

It will be appreciated that in all embodiments the capacitor 2 has two metal plates of appropriate areas spaced by air and/or plastics dielectric, allowing the antenna element to move slidably and/or pivotally with respect to the radio housing, without the need for any other electrical link. The dielectric could be any non-metallic material.

I claim:

1. A radio antenna comprising a main antenna element, a housing with respect to which the main antenna element is slidably movable between an extended position of the element and a retracted position of the element, a first electrically conducting member attached to the housing and forming a stationary capacitor plate for connection to radio transmitting or receiving apparatus, a second electrically conducting member attached to an inner end of the main antenna element and forming a movable capacitor plate, and a further antenna element carried by the housing for connecting to the radio transmitting or receiving apparatus, in the extended position of the main antenna element the stationary and movable capacitor plates forming a capacitor which constitutes an electrical signal link between the main antenna element and the radio transmitting or receiving apparatus, in the retracted position of the main antenna element the movable capacitor plate being spaced from the stationary capacitor plate so as effectively to disconnect the electrical signal link, the further antenna element comprising a receiving/transmitting antenna element when the main antenna element is in the retracted position thereof, the main antenna element being an elongated rod which passes through a central aperture in the stationary capacitor plate, and including a dielectric washer attached to the stationary capacitor plate, the washer being disposed between the movable and stationary capacitor plates in the extended position of the main antenna element.

2. A radio antenna according to claim 1, wherein the stationary capacitor plate is tubular and a dielectric sleeve is positioned within the stationary capacitor plate, the sleeve occupying an annular region between the stationary and movable capacitor plates in the extended position of the main antenna element.

3. A radio antenna according to claim 2, wherein the movable capacitor plate is formed by a thickened end of the main antenna element.

4. A radio antenna according to claim 1, wherein the further antenna element is helical and surrounds the main antenna element.

5. A radio antenna according to claim 4, wherein the main antenna element has a portion of its length made of a non-electrically conducting material, said portion of the length of the main antenna element being disposed within the further antenna element when the main antenna element is in the retracted position, so that no metal lies within a field of the further antenna element when the main antenna element is in the retracted position thereof.

6. A radio antenna according to claim 4, wherein the further antenna element is surrounded and protected by a tapering plastic sleeve, and an outer end of the main antenna element carries a projecting cap which closes off the plastic sleeve when the main antenna element is in the retracted position thereof.

7. A portable radio including an antenna as claimed in claim 1.

* * * * *